US006023820A

United States Patent [19]

Fair

[11] Patent Number: 6,023,820

[45] Date of Patent: Feb. 15, 2000

[54] SOFT CARRIER BUCKLE

[75] Inventor: Paul Fair, Denver, Colo.

[73] Assignee: Evenflo Company, Inc., Vandalia, Ohio

[21] Appl. No.: 09/175,899

[22] Filed: Oct. 20, 1998

[51] Int. Cl.[7] ..... A44B 11/25

[52] U.S. Cl. ..... 24/614; 24/312; 24/313

[58] Field of Search ..... 24/614, 630, 601.7, 24/580, 588, 312, 313, 319

[56] References Cited

U.S. PATENT DOCUMENTS

| | | | |
|---|---|---|---|
| 658,115 | 9/1900 | Murray | 24/312 X |
| 1,821,839 | 9/1931 | Kerngood | 24/312 |
| 1,853,884 | 4/1932 | Russell | 24/313 |
| 2,893,094 | 7/1959 | Heckethorn | 24/601.7 X |
| 5,551,131 | 9/1996 | Anscher | 24/614 |

*Primary Examiner*—James R. Brittain
*Assistant Examiner*—Robert J. Sandy
*Attorney, Agent, or Firm*—Thompson Hine & Flory LLP

[57] ABSTRACT

A buckle system comprising a fixed part is disclosed. The fixed part has a front face and a rear face with a first leg and a second leg and, therebetween, an interior leg and an exterior leg and a central leg. A movable part has a front face and a rear face with an upper leg and a lower leg. Therebetween is an interior leg and an exterior leg and a central leg. A locking plate extends upwardly from the central leg of the fixed part with a section extending interiorly thereof. The locking plate forms a space between the locking plate and the remainder of the fixed part. The interior leg of the movable part has a height greater than the height of the locking plate and a diameter slightly greater than the space between the locking plate and the remainder of the fixed part.

6 Claims, 3 Drawing Sheets

SOFT CARRIER BUCKLE

BACKGROUND OF THE INVENTION

1. Field of the Invention

The present invention relates to a new and improved buckle with separable parts and, more particularly, pertains to effecting the secure and convenient coupling and uncoupling of buckle components.

2. Description of the Prior Art

The use of buckles of known designs and configurations is known in the prior art. More specifically, buckles of known designs and configurations heretofore devised and utilized for the purpose of coupling and uncoupling buckle components through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of buckles of known designs and configurations. By way of example, U.S. Pat. No. 924,633 to Caldwell, issued Jun. 15, 1909 discloses a fastening device for blankets and other articles. U.S. Pat. No. 1,331,106 to Hermanson, issued Feb. 17, 1920, discloses a fastening. U.S. Pat. No. 2,893,094 to Heckethorn, issued Jul. 7, 1959 and assigned on its face to Heckethorn Mfg. & Supply Company, discloses a strap fastener. U.S. Pat. No. 3,016,593 to Rowles, issued Jan. 16, 1962 and assigned on its face to Universal Button Company, discloses an improved hook for a hook-and-eye fastener. U.S. Pat. No. 3,170,210 to Frew, issued Feb. 23, 1965 and assigned to Waterbury Buckle Company, discloses a hook and eye. Lastly, U.S. Pat. No. 3,196,509 to Frew, issued Jul. 27, 1965 and assigned to Waterbury Buckle Company, discloses a safety seat buckle for aircraft and motor vehicles.

In this respect, the a buckle with separable parts according to the present invention substantially departs from the conventional concepts and designs of the prior art, and in doing so provides an apparatus primarily developed for the purpose of effecting the secure and convenient coupling and uncoupling of buckle components.

Therefore, it can be appreciated that there exists a continuing need for a new and improved buckle with separable parts which can be used for effecting the secure and convenient coupling and uncoupling of buckle components. In this regard, the present invention substantially fulfills this need.

SUMMARY OF THE INVENTION

In view of the foregoing disadvantages inherent in the known types of buckles of known designs and configurations now present in the prior art, the present invention provides a new and improved buckle with separable parts. As such, the general purpose of the present invention, which will be described subsequently in greater detail, is to provide a new and improved buckle with separable parts and methods which have all the advantages of the prior art and none of the disadvantages.

To attain this, the present invention essentially comprises a new and improved buckle system for the convenient coupling and uncoupling of separate parts to be releasably joined. The buckle system includes a fixed part. The fixed part has a front face and a rear face with an upper horizontal leg and a lower horizontal leg. Therebetween are an interior vertical leg, an exterior vertical leg and a central vertical leg.

The central vertical extent includes a raised portion. A movable part is included and has a front face and a rear face with an upper horizontal leg and a lower horizontal leg. Therebetween are an interior vertical leg, an exterior vertical leg and a central vertical leg. A resilient locking plate extends upwardly from the central vertical leg of the fixed part with a section extending interiorly thereof. The locking plate forms a space between the locking plate and the remainder of the fixed part. The interior vertical leg of the movable part is cylindrical and has a height greater than the height of the locking plate and a diameter slightly greater than the space between the locking plate and the remainder of the fixed part.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved buckle with separable parts which has all the advantages of the prior art buckles of known designs and configurations and none of the disadvantages.

It is an other object of the present invention to provide a new and improved buckle with separable parts which may be easily and efficiently manufactured and marketed and which promotes the safety of child care products.

It is a further object of the present invention to provide a new and improved buckle with separable parts which is of a durable and reliable construction for increasing the convenience to a child care provider.

An even further object of the present invention is to provide a new and improved buckle with separable parts which is susceptible of a low cost of manufacture with regard to both materials and labor, and which accordingly is then susceptible of low prices of sale to the consuming public, thereby making such a buckle with separable parts economically available to the buying public.

Even still another object of the present invention is to effect the secure and convenient coupling and uncoupling of buckle components.

Lastly, it is an object of the present invention to provide a buckle system comprising a fixed part. The fixed part has a front face and a rear face with a first leg and a second leg and, therebetween, an interior leg and an exterior leg and a central leg. A movable part has a front face and a rear face with an upper leg and a lower leg. Therebetween is an interior leg and an exterior leg and a central leg. A locking plate extends upwardly from the central leg of the fixed part with a section extending interiorly thereof. The locking plate forms a space between the locking plate and the remainder of the fixed part. The interior leg of the movable part has a height greater than the height of the locking plate and a diameter slightly greater than the space between the locking plate and the remainder of the fixed part.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
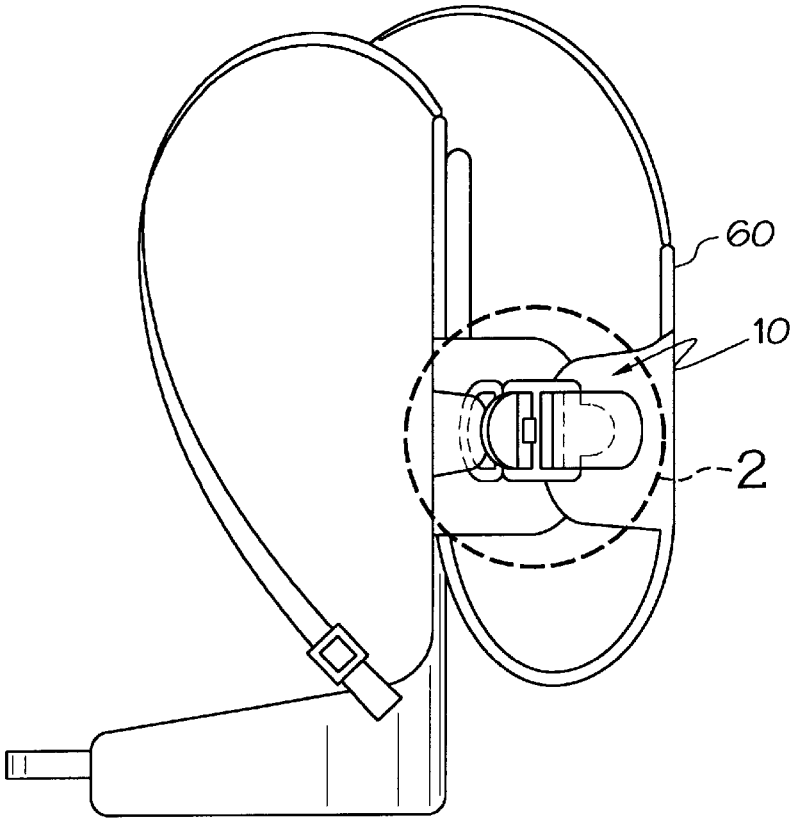
FIG. 1 is a side elevational view of an infant carrier with the preferred embodiment of the buckle with separable parts constructed in accordance with the principles of the present invention.
Figure 2:
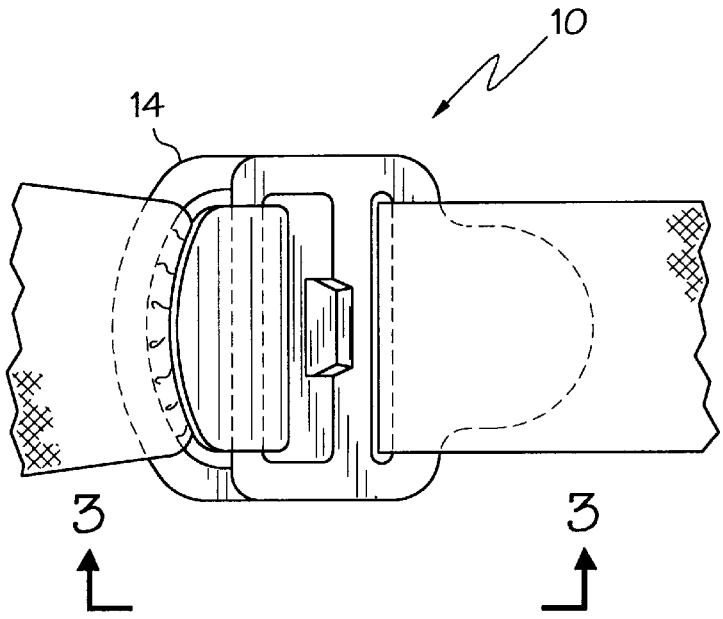
FIG. 2 is a front elevational view of the buckle taken at circle 2 of FIG. 1.
Figure 3:
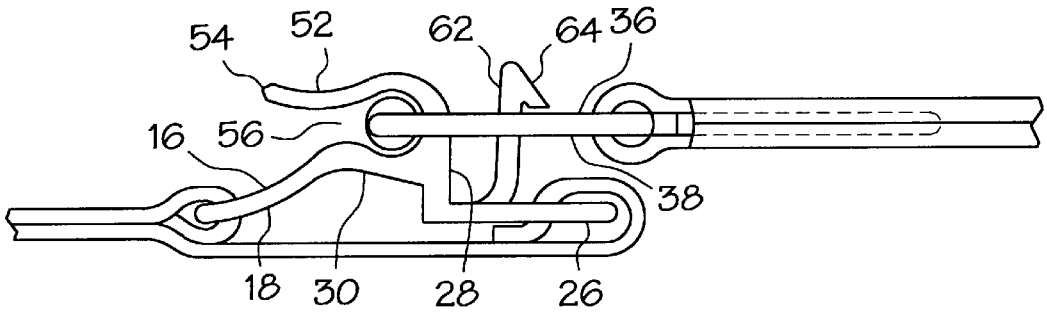
FIG. 3 is a bottom elevational view of the buckle taken along line 3—3 of FIG. 2.
Figure 4:
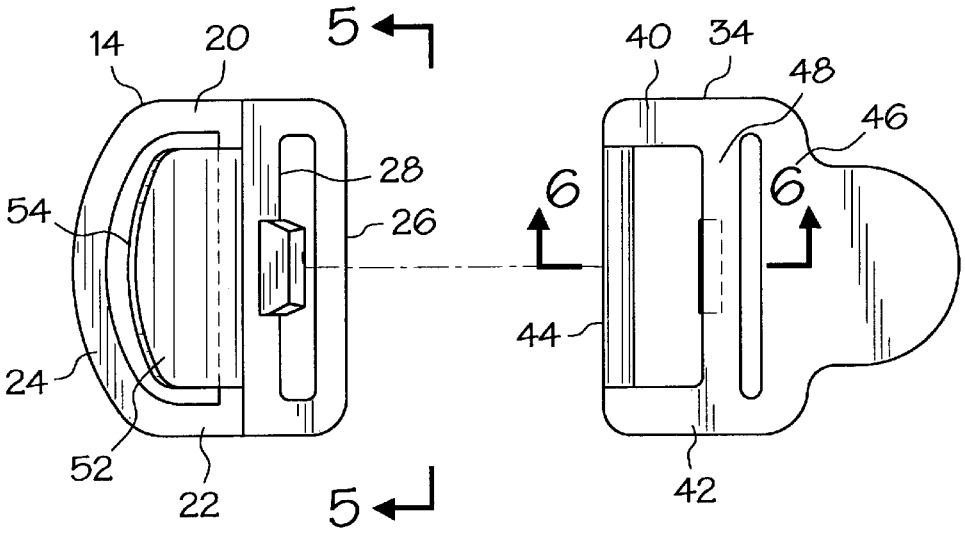
FIG. 4 is a front elevational view of the buckle parts in a separated orientation.
Figure 5:
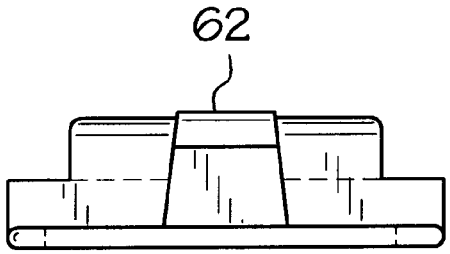
FIG. 5 is an end elevational view of one of the buckle components taken along line 5—5 of FIG. 4.
Figure 6:
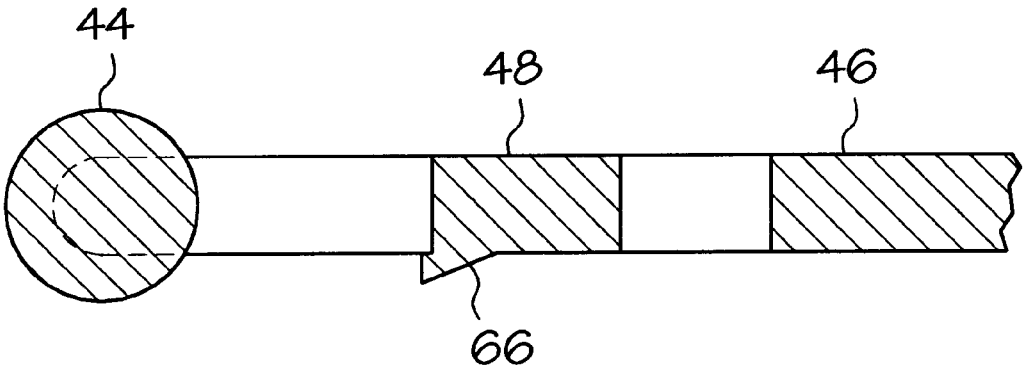
FIG. 6 is a cross-sectional view taken along line 6—6 of FIG. 4.

With reference now to the drawings, and in particular to FIGS. 1 through 6 thereof, the preferred embodiment of the new and improved buckle with separable parts embodying the principles and concepts of the present invention and generally designated by the reference numeral 10 will be described.

The present invention, the new and improved buckle with separable parts, is a system 10 comprised of a plurality of components. Such components, in their broadest context, include a fixed part, a movable part, a locking plate, and upper, lower, interior, exterior and central legs. Each of the individual components is specifically configured and correlated one with respect to the other so as to attain the desired objectives.

The present invention includes a new and improved buckle system 10 for the convenient coupling and uncoupling of separate parts to be releasably joined. The buckle system includes a movable part and a fixed part 14.

The fixed part 14 has a front face 16 and a rear face 18. It also has an upper horizontal leg 20 and a lower horizontal leg 22. Between the upper and lower legs are an interior vertical leg 24, an exterior vertical leg 26 and a central vertical leg 28. The interior vertical leg is coupled to the fabric edge of the parts being coupled. The central vertical extent of the fixed part includes a raised portion 30.

A movable part 34 is next provided. Such movable part includes a front face 36 and a rear face 38. Also included is an upper horizontal leg 40 and a lower horizontal leg 42. Therebetween are an interior vertical leg 44, an exterior vertical leg 46 and a central vertical leg 48. The exterior vertical leg is coupled to the fabric edge of the parts being coupled.

A resilient locking plate 52 is next provided. Such locking plate extends upwardly from the central vertical leg 28 of the fixed part. Such plate has a section 54 extending interiorly thereof. The locking plate forms a space 56 between the locking plate and the remainder of the fixed part therebeneath.

The interior vertical leg 44 of the movable part is cylindrical. It has a height greater than the height of the locking plate which is less than the height of the vertical legs of the fixed part. The cylindrical leg 44 has a diameter slightly greater than the space 56 between the locking plate and the remainder of the fixed part. In this manner, it may be coupled and uncoupled with respect to the locking plate by a lateral force to resiliently move the locking plate 52 for coupling and uncoupling the buckle. The parts of the buckle are preferably molded of a relatively slightly resilient plastic, preferably polycarbonate.

Additional security of coupling is effected through an upwardly extending finger 62 integrally formed with the central vertical leg of the fixed part. Such finger has a forwardly extending projection 64 positionable on the central vertical leg of the movable part when coupled. Movement of the finger toward the cylindrical leg 44, followed by pivoting the non-cylindrical legs of the movable part are required prior to sliding the cylindrical leg out of locking engagement. Downward projection 66 on the intermediate leg 48 ensures proper locking engagement between the parts.

The buckle of the present application has utility in association with the soft infant carrier as described in U.S. patent application Ser. No. 09/175,898, filed concurrently herewith and entitled Soft Infant Carrier, the subject matter of which is incorporated herein by reference.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved buckle system for the convenient coupling and upcoupling of separate parts to be releasably joined, comprising, in combination:

a fixed part having a front face and a rear face with an upper horizontal leg and a lower horizontal leg and, therebetween, an interior vertical leg and an exterior vertical leg and a central vertical leg, the central vertical leg including a raised portion;

a movable part having a front face and a rear face with an upper horizontal leg and a lower horizontal leg and, therebetween, an interior vertical leg and an exterior vertical leg and a central vertical leg;

a resilient locking plate extending upwardly from the central vertical leg of the fixed part with a section extending interiorly thereof, the locking plate forming a sidewardly opening space between the locking plate and a portion of the front face of the fixed part for receiving the interior vertical leg of the movable part; and the interior vertical leg of the movable part being cylindrical having a height greater than the height of the locking plate and a diameter slightly greater than the space between the locking plate and the portion of the front face of the fixed part.

2. A buckle system comprising:

a fixed part having a front face and a rear face with a first leg and a second leg and, therebetween, an interior leg and an exterior leg and a central leg;

a movable part having a front face and a rear face with an upper leg and a lower leg and, therebetween, an interior leg and an exterior leg and a central leg;

a locking plate extending upwardly from the central leg of the fixed part with a section extending interiorly thereof, the locking plate forming a sidewardly opening space between the locking plate and a portion of the front face of the fixed part for receiving the interior leg of the movable part; and the interior leg of the movable part having a height greater than the height of the locking plate and a diameter slightly greater than the space between the locking plate and the portion of the front face of the fixed part.

3. The buckle system as set forth in claim 2 wherein the locking plate is resilient.

4. The buckle system as set forth in claim 2 wherein the interior leg of the movable part is cylindrical.

5. The buckle system as set forth in claim 2 and further including an upwardly extending finger on the central leg of the fixed part with a projection extending over the central leg of the movable part for increased security.

6. A buckle system comprising:

a fixed part having a front face and a rear face with a first leg and a second leg and, therebetween, an interior leg and exterior leg and a central leg;

a movable part having a front face and a rear face with an upper leg and a lower leg and, therebetween, an interior leg and an exterior leg and a central leg;

a locking plate extending upwardly from the central leg of the fixed part with a section extending interiorly thereof, the locking plate forming a space between the locking plate and a portion of the front face of the fixed part;

the interior leg of the movable part having a height greater than the height of the locking plate and a diameter slightly greater than the space between the locking plate and the portion of the front face of the fixed part; and an upwardly extending finger on the central leg of the fixed part with a projection extending over the central leg of the movable part for increased security.

* * * * *